United States Patent [19]

Vettiger

[11] 4,116,243

[45] Sep. 26, 1978

[54] JET LOOM

[75] Inventor: Alfons Vettiger, Tann-Ruti, Switzerland

[73] Assignee: Ruti Machinery Works Ltd., Ruti, Switzerland

[21] Appl. No.: 783,423

[22] Filed: Mar. 31, 1977

[30] Foreign Application Priority Data

Apr. 13, 1976 [CH] Switzerland ..... 4729/76

[51] Int. Cl.[2] ..... D03D 47/28

[52] U.S. Cl. ..... 139/435; 139/192

[58] Field of Search ..... 139/435, 449, 450, 188 R, 139/192, 292

[56] References Cited

U.S. PATENT DOCUMENTS

| | | | |
|---|---|---|---|
| 1,721,940 | 7/1929 | Ballou | 139/435 |
| 3,818,952 | 6/1974 | Verneulen | 139/435 |

FOREIGN PATENT DOCUMENTS

| | | | |
|---|---|---|---|
| 862,093 | 3/1961 | Great Britain | 139/435 |

*Primary Examiner*—Henry S. Jaudon

*Attorney, Agent, or Firm*—Donald D. Denton

[57] ABSTRACT

A jet loom having straight and recessed reed teeth with the rearmost region of the recesses laying in a plane defined by the front side of the straight reed teeth, with the recesses forming a channel for fluid insertion of weft threads.

8 Claims, 2 Drawing Figures

JET LOOM

BACKGROUND OF THE INVENTION

The present invention relates to a jet type loom in which the filling threads are introduced into the shed of the loom by means of a jet of gaseous fluid, the loom having temples arranged on both sides of the fabric and a reed, with reed teeth provided with recesses which together form a channel for the gaseous fluid.

In known jet looms of this type, the beating-up of the filling thread is effected by the region of the recesses of the reed teeth which is furthest away from the fell of the cloth. This results in difficulties because of the temples present on both sides of the fabric. In order that the amount of air required for the insertion can be kept as small as possible, the cross-section of the air channel should not exceed a certain value. This value is, as a rule, smaller than the cross-section of the temples so that only the front edges of the reed teeth can be moved up to the temples. Since the beating-up of the filling threads is effected by the rearmost region of the channel-forming recesses, it necessarily results that the fell of the cloth cannot be located directly at the temples but must be at a distance from them which corresponds to the depth of the channel-forming recesses of the reed teeth. It follows from this that the piece of fabric is undesirably narrowed from the temples towards the warp threads.

In connection with this application, there is no prior art known to applicant.

SUMMARY OF THE INVENTION

The above disadvantage is overcome by the present invention in that it is characterized by the fact that the reed is provided at each of its ends, corresponding to the length of the temples, with a region having exclusively straight reed teeth, and that in the case of the reed teeth provided with recesses, the rearmost region of the recesses lies in the plane defined by the front sides of the straight reed teeth.

BRIEF DESCRIPTION OF THE DRAWING

The invention will be described in further detail below with reference to an illustrative embodiment and the figures of the accompanying drawing, in which.

DESCRIPTION OF PREFERRED EMBODIMENTS

Figure 1:
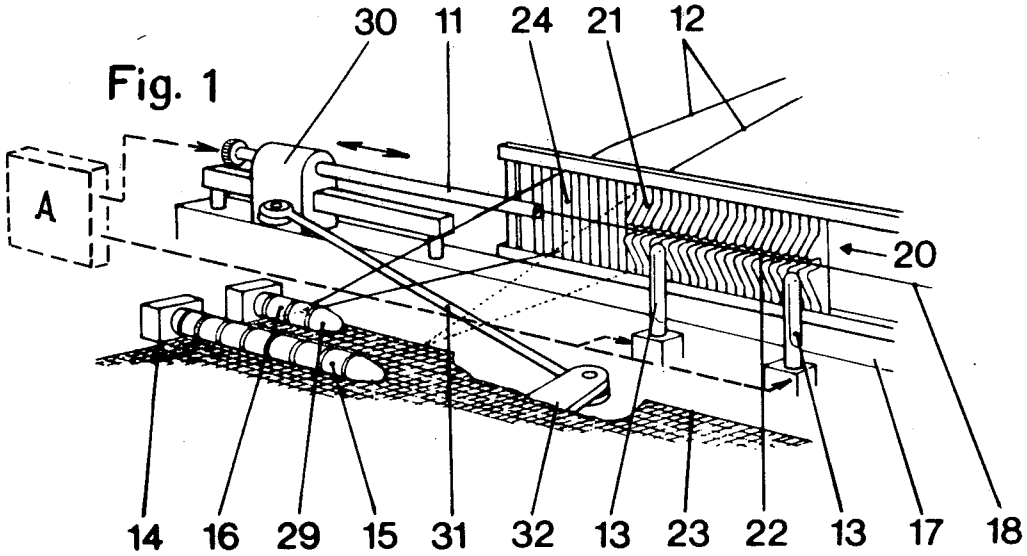
FIG. 1 is a schematic view in perspective of the filling-thread insertion side of a loom.

In FIG. 1 there is illustrated a jet weft thread insertion means having a main nozzle 11 by means of which filling threads 18 are jet inserted into the shed of the loom formed by the warp threads 12, as well as auxiliary nozzles 13 provided to assist the main nozzle 11 during insertion. Furthermore, there are provided two temples 15, 16, and a batten 17. The main nozzle 11 and the auxiliary nozzles 13 are moved together with the batten 17. The woven cloth produced by the operation of the loom is designated 14.

On the batten 17 there is mounted a reed 20. It consists, on the one hand, of reed teeth 21, each of which has a recess 22. The recesses 22 together form a channel through which the gaseous fluid blown out of the nozzles 11, 13 flows, whereby the filling threads 18 are introduced into the shed. These filling threads come to lie in this connection in the channel formed by the recesses 22 and are beaten-up by the rearmost region 25 of each recess 22 (see FIG. 2).

If the reed teeth 21 having recesses 22 were present over the entire length of the reed and the recesses 22 were not so large that they can surround the temple 16, the reed 20 could be moved forward only to such an extent that in its frontmost position the projections 26, 27 are directly against the temple 16. Accordingly, the fell 23 of the cloth cannot lie directly at the temple but must be located at a distance from it which is, at least approximately, equal to the distance *a* shown in FIG. 2.

Upon weaving, the corresponding fabric, as is known, shrinks in width and the purpose of the temples is to prevent this in the region of the fabric which has been last woven.

For this purpose, the temples must be arranged as close as possible to the fell of the cloth. If, however, the spacing *a* cannot be avoided, then there is necessarily a tapering or moving together of the fabric 14 between the temple 16 and the temple corresponding to it on the right-hand side of the loom towards the fell 23 of the cloth. Thus the warp threads 12 also move together from the reed 20 towards the fell 23 of the cloth since they are held in their desired position in the widthwise direction of the fabric by the reed teeth. Thus, in particular, the outermost warp threads together with the strip of fabric adjoining the fell 23 of the cloth, will be spread apart in widthwise direction by the reed teeth when the reed 20 moves towards the fell 23 of the cloth. In this way the warp threads are undesirably rubbed-against by the reed teeth.

In order to avoid this, those reed teeth which are moved directly against the temple 16 upon the beating-up of the filling thread do not have a recess but are developed as conventional reed teeth 24. The region having exclusively straight reed teeth 24 extends, in this connection, towards the center of the reed up to at least a place the continued imaginary path of movement of which passes through the tapering free temple tip 29. In this connection the arrangement is such that the rearmost part 25 of the recesses 22 lies in the plane defined by the front sides of the teeth 24.

On the right-hand side (not shown in FIG. 1) of the loom, the development of the reed is similar to the development on the left side, which is shown in the drawing.

Figure 2:
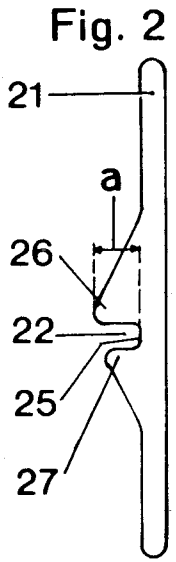
FIG. 2 is a side view of a reed tooth provided with a recess.

The rearmost part 25 of the reed teeth 21 having recesses 22 is preferably formed by a linear edge piece, as can be noted from FIG. 2. As is known, it may happen that the cloth 14, and thus the fell 23 of the cloth, comes to lie at somewhat different heights. A curved rear part of the recess 22 would mean that, upon different positions in height of the cloth 14, the places at which the beating-up of the thread takes place are also at points displaced with respect to each other in horizontal direction, so that the linearity of the fell 23 of the cloth would not be assured with the required accuracy. It has been found that this disadvantage is avoided, on the one hand, if the rearmost part of the recess 22 is formed by a linear edge piece 25 which lies in the plane defined by the front sides of the straight reed teeth 24. The said disadvantage can however also be avoided by providing conventional straight reed teeth 24 between the reed teeth 21 which are provided with the recesses 22. The teeth 21 and the conventional teeth 24 should alternate with each other in regular succession, the simplest succession being that in which each tooth 21 having a recess is followed by a conventional straight tooth 24. The straight teeth 24 present between the teeth 21 lie in exactly the same plane as the teeth 24 at the reed ends so that all of these teeth produce a straight fell, in which no deviations possibly produced by teeth 21 are noticeable.

As can furthermore be noted from FIG. 1, the main nozzle 11 is borne by a carriage 30. The carriage 30 is displaceable along the batten 17. A rod 31 swingably fastened at its two ends connects the carriage 30 to a part 32 which is fixed to the loom. The rod 31 is located below the woven cloth 14 and below the warp threads 12.

When the batten 17, together with the reed 20, is in the rear position, the shed is opened and the filling thread 18 is inserted. As can be readily noted from FIG. 1, upon the movement of the batten towards the rear, the carriage 30 bearing the nozzle 11 is pulled to the right so that the nozzle moves into the shed and against the reed teeth 21 provided with recesses 22. This has the advantage that during the blowing process the nozzle outlet opening is located near to or in the air channel formed by the recesses 22, and the jet of air remains focused by the recesses 22 for weft insertion.

Similar to the main or blast nozzle 11, there can be provided on the other side of the shed a means for picking up the filling thread, for instance a suction nozzle, which has the purpose of picking up again the thread which has been blown through the shed. This suction nozzle can also be carried by a carriage in exactly the same manner as the main nozzle 11, its carriage being supported slidably parallel to the batten 17 on the latter and being displaceable by means of a rod fastened at one end to a fixed piece, similar to the rod 31 and the piece 32, with both the main nozzle and the suction nozzle moving simultaneously during the movement of the batten. By bringing the opening of the suction nozzle near to or into the channel formed by the recesses 22, the picking-up of the front end of the filling thread is facilitated.

There can also be noted in FIG. 1 two temples 16 and 15 arranged one behind the other, the temple 16 which is closer to the reed being shorter than the temple 15 which is further away from the reed, so that the region of the conventional reed teeth 24 can be kept short. The purpose in this connection of the temple 15 is to relieve the temple 16.

As can be seen from FIG. 1, A represents the means for supplying weft thread and a fluid to the main nozzle for jet or blast weft thread insertion and for supplying fluid to the auxiliary nozzles 13.

It will be appreciated that, where a weft thread pick-up means is employed, means is provided for producing suction to facilitate receiving the inserted weft thread.

It will also be appreciated that various changes and/or modifications may be made within the skill of the art without departing from the spirit and scope of the invention illustrated, described, and claimed herein.

What is claimed is:

1. Jet loom having a device for the inserting of filling yarns by means of a gaseous fluid, a reed for beating up the inserted filling yarns to the fell of the cloth and temples arranged on both sides of the cloth, said reed comprising reed teeth provided with recesses, which recesses together form a channel for the gaseous fluid and straight reed teeth, the reed teeth with recesses being provided along the portion of the reed between the inner ends of the temples and the straight reed teeth being provided along the portions of the reed along the temples, the rearmost region of the recesses lying in the plane defined by the front edges of the straight reed teeth.

2. The jet loom according to claim 1 in which at each end of the reed the region having straight reed teeth is extended at least to the place whose continued imaginary path of movement extends through a tapering free temple tip.

3. The jet loom according to claim 1 in which at least on one side of the fabric two temples are arranged one behind the other, the temple which is nearer the fell of the cloth being shorter than the other temple.

4. The jet loom according to claim 1 in which on the one end of the reed there is provided a jet weft thread insertion means having means operatively associated therewith for moving the insertion means in synchronism with the movement of the reed in the longitudinal direction of the reed over at least a part of the region of the reed that is provided exclusively with straight reed teeth, the insertion means moving, in the front position of the reed at the fell of the cloth, out of the shed and, in the rear position of the reed, towards the center of the reed.

5. The jet loom according to claim 1 in which at the other end of the reed a means for picking up the filling thread is movable over at least a part of the region of the reed provided exclusively with straight reed teeth, in the longitudinal direction of said reed in synchronism with the movement of the reed and is moved, in the front position of the reed at the fell of the cloth, out of the shed and, in the rear position of the reed, towards the center of the reed.

6. The jet loom according to claim 4 in which at the other end of the reed a means for picking up the filling thread is movable over at least a part of the region of the reed provided exclusively with straight reed teeth, in the longitudinal direction of said reed in synchronism with the movement of the reed and is moved, in the front position of the reed at the fell of the cloth, out of the shed and, in the rear position of the reed, towards the center of the reed.

7. The jet loom according to claim 1 in which the rearmost region of the recesses is linear and lies in the plane defined by the front sides of the straight reed teeth.

8. The jet loom according to claim 1 in which the reed teeth which are provided with recesses alternate with straight reed teeth.

* * * * *